US006264501B1

(12) United States Patent
Hung et al.

(10) Patent No.: US 6,264,501 B1
(45) Date of Patent: Jul. 24, 2001

(54) CONNECTOR ASSEMBLY

(75) Inventors: Ya-Ling Hung; Chun-Hsien Hsu, both of Taipei Hsien (TW)

(73) Assignee: Tekcon Electronics Corp., Taipei (TW)

( * ) Notice: Subject to any disclaimer, the term of this patent is extended or adjusted under 35 U.S.C. 154(b) by 0 days.

(21) Appl. No.: 09/421,547

(22) Filed: Oct. 20, 1999

(51) Int. Cl.[7] ..... H01R 9/22; H01R 13/60; H01R 13/66

(52) U.S. Cl. ..... 439/541.5; 439/939; 439/717

(58) Field of Search ..... 439/541.5, 540.1, 439/527, 939, 701, 717

(56) References Cited

U.S. PATENT DOCUMENTS 5,037,330 * 8/1991 Fulponi et al. ..... 439/607
5,161,997 * 11/1992 Defibaugh et al. ..... 439/532
5,622,523 * 4/1997 Kan et al. ..... 439/607
5,695,362 * 12/1997 Hillbish et al. ..... 439/541.5
5,975,961 * 11/1999 Atsumi et al. ..... 439/701
5,984,732 * 11/1999 Mehring ..... 439/701
6,004,146 * 12/1999 Tan et al. ..... 439/92

* cited by examiner

*Primary Examiner*—Paula Bradley
*Assistant Examiner*—Edwin A. León

(57) ABSTRACT

The present invention provides a connector assembly composed of two different types of connectors stacked on an upper layer and a lower, respectively. The same connectors are mounted on the same layer and arranged side-by-side. The adjacent connectors are fixed by male mating unit and female mating unit, whereby those connectors can be arranged in stacking and side-by-side manner. Moreover, the connectors of different types are labeled with different color for preventing wrong insertion.

7 Claims, 6 Drawing Sheets

CONNECTOR ASSEMBLY

FIELD OF THE INVENTION

The present invention relates to a connector assembly, especially to a connector assembly composed of at least two connectors of different format and same width or length, whereby those connectors can be easily assembled to a connector assembly and provide connection function for different connector format.

BACKGROUND OF THE INVENTION

The present computer generally uses two type of connector, i.e., PS/2 (Mini-Din) connector 1 and USB connector 2 as shown in FIG. 6. The PS/2 connector 1 and USB connector 2 are generally of two-layer structure, and to save space, the PS/2 connector 1 and USB connector 2 are generally in stacking arrangement or side-by-side arrangement. These kind of arrangement makes the molding operation more complicated. More particularly, the PS/2 connector 1 is generally 6-pin connector with the 6 slots arranged in symmetrically ring shape. Moreover, the upper connector of a stacking type PS/2 connector assembly has longer terminal and the lower connector of the stacking type PS/2 connector assembly has shorter terminal. As shown in FIG. 7, a stacking type PS/2 connector assembly comprises 12 terminals 31*a*, 31*b*, 32*a*, 32*b*, 33*a*, 33*b*, 34*a*, 34*b*, 35*a*, 35*b*, 36*a*, and 36*b* inserted into an insulating stage 37, and a front shell 38 and rear shell 39 sealing the insulating stage 37. In other words, it is necessary to prepare 12 set of molding dies for the 12 terminals and different molding dies for the insulating stage, the front shell and the rear shell. The cost is high and the manage of components is complicated. As to the USB connector, it is necessary to prepare two sets of molding dies for the terminal of the upper connector and the lower connector. The cost is also high and the manage of components is also complicated. Moreover, the occupied height is relatively large.

It is an object of the present invention to provide a connector assembly, which is easily assembled and of low cost.

It is an object of the present invention to provide a connector assembly, which is designed, for preventing careless insertion.

In one aspect of the invention, the present invention provides a connector assembly composed of PS/2 (Mini-Din) connectors and USB connectors staked on an upper layer and a lower, respectively. The same connectors are mounted on the same layer. For examples, the PS/2 (Mini-Din) connectors are arranged on the upper layer and the USB connectors are arranged on the lower layer. In this way, six molding dies for the six terminal of the PS/2 (Mini-Din) connector, one molding die for the four terminals of the USB connector, a molding die for the insulating stage and a molding die for the shielding case are saved. In other word, the present invention can achieve connector assembly with two different type connector on upper and lower layer only by a molding die for upper connector (PS/2 connector), a molding die for lower connector (USB connector), a molding die for the shielding case, a molding die for the terminal of the lower connector and six molding dies for the upper terminals.

In another aspect of the present invention, the upper connectors and the lower connectors are combined to form a connector assembly and the adjacent connectors are fixed by male mating unit and female mating unit, whereby those connectors can be arranged in stacking and side-by-side manner. Moreover, the connectors of different types are labeled with different color for preventing wrong insertion.

The various objects and advantages of the present invention will be more readily understood from the following detailed description when read in conjunction with the appended drawing, in which:

DETAILED DESCRIPTION OF PREFERRED EMBODIMENT

Figure 3:
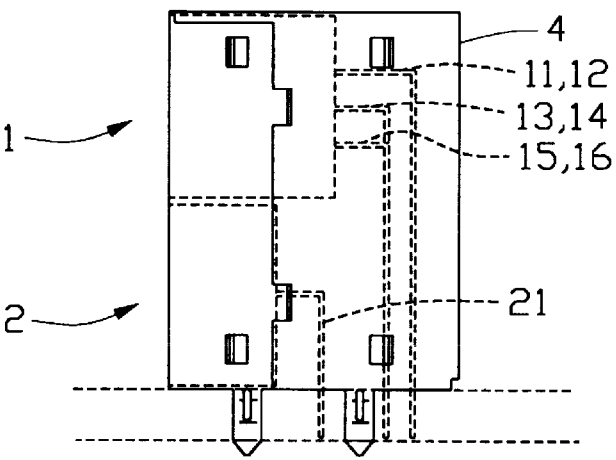
FIG. 3 is the cross section view of the present invention.
Figure 1:
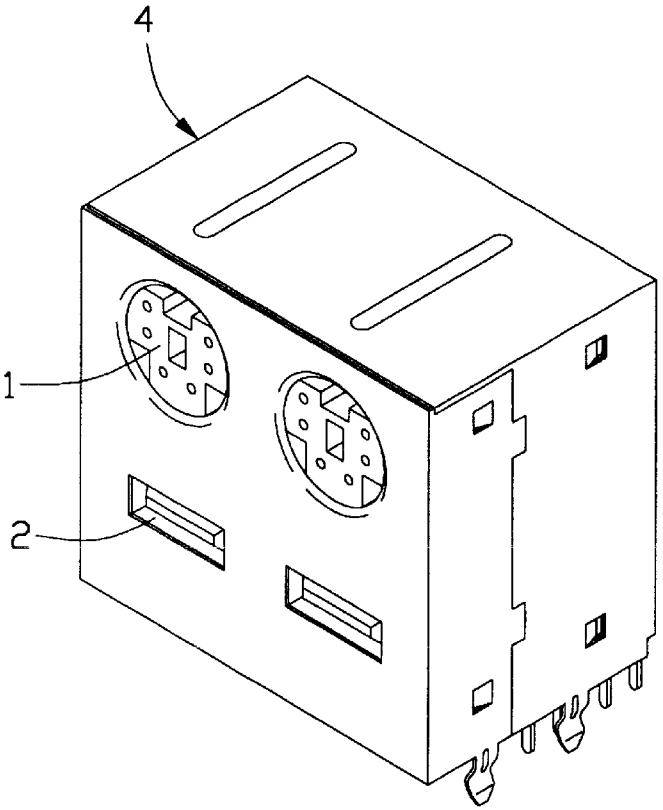
FIG. 1 is the perspective view of the present invention.
Figure 2:
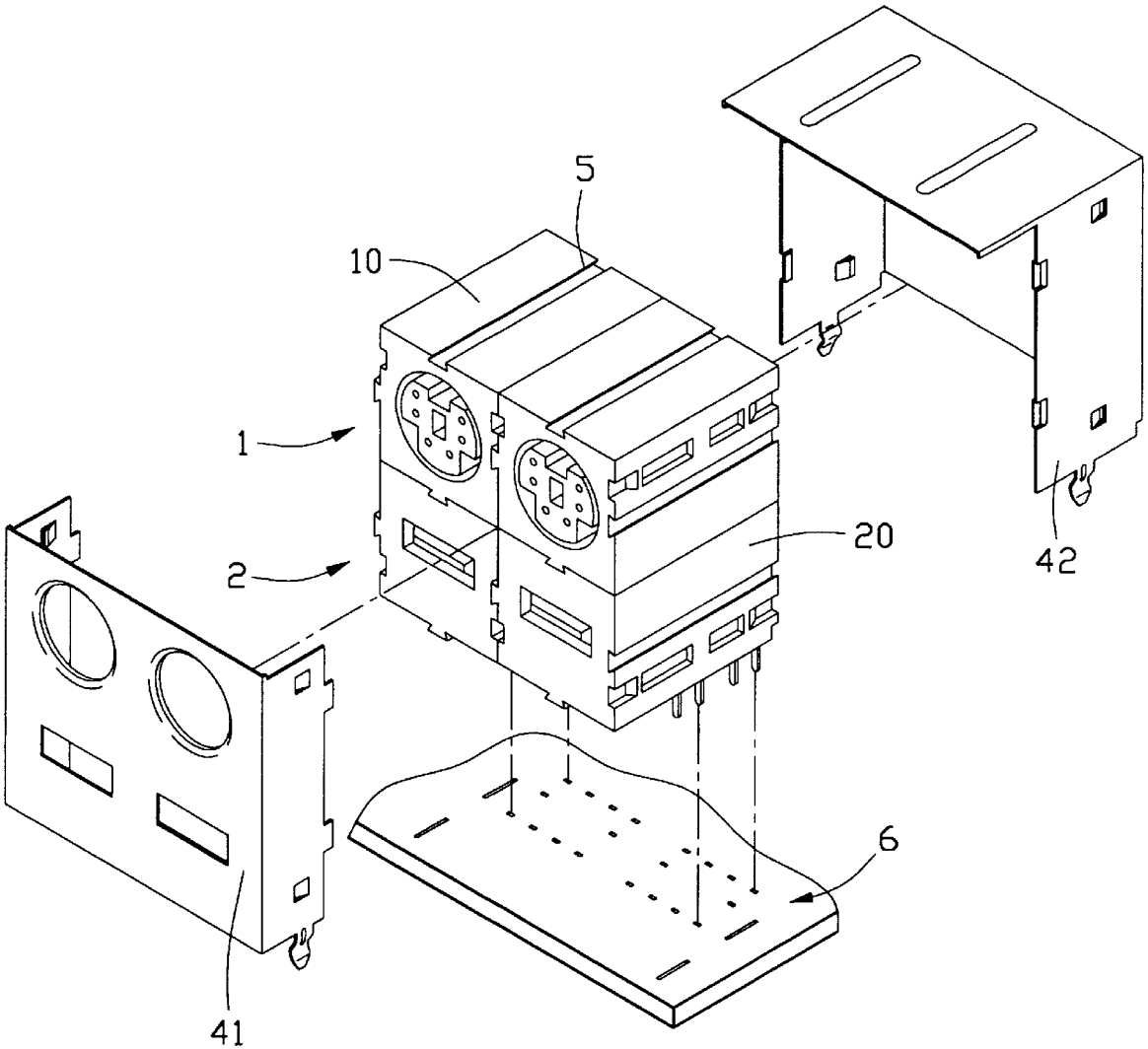
FIG. 2 is the exploded view of the present invention.

With reference to FIGS. 1–3, the present invention is intended to provide a connector assembly, which is easily assembled and of low cost, and designed for preventing careless insertion. The connector assembly comprises at least one upper PS/2 Mini-Din type connector 1 and at least one lower USB type connector 2. The upper connector 1 and lower connector 2 are m stacking arrangement such that an insulating stage 5 is formed by the stacked connectors 1 and 2. The insulating stage 5 is enclosed by a shielding case 4 composed of an outer case 41 and an inner case 42 formed by pressing and having shape corresponding to that of the insulating stage 5. The terminals 11–16 and 21 of the upper connector 1 and lower connector 2 are sequentially arranged within corresponding connector to save cost and minimize used space. As shown in FIG. 1, the USB connector 2 is arranged on lower position. However, the USB connector 2 can also be arranged on upper position as long as the upper connector and the lower connector of different, have the same width for easy assembling.

Figure 4:
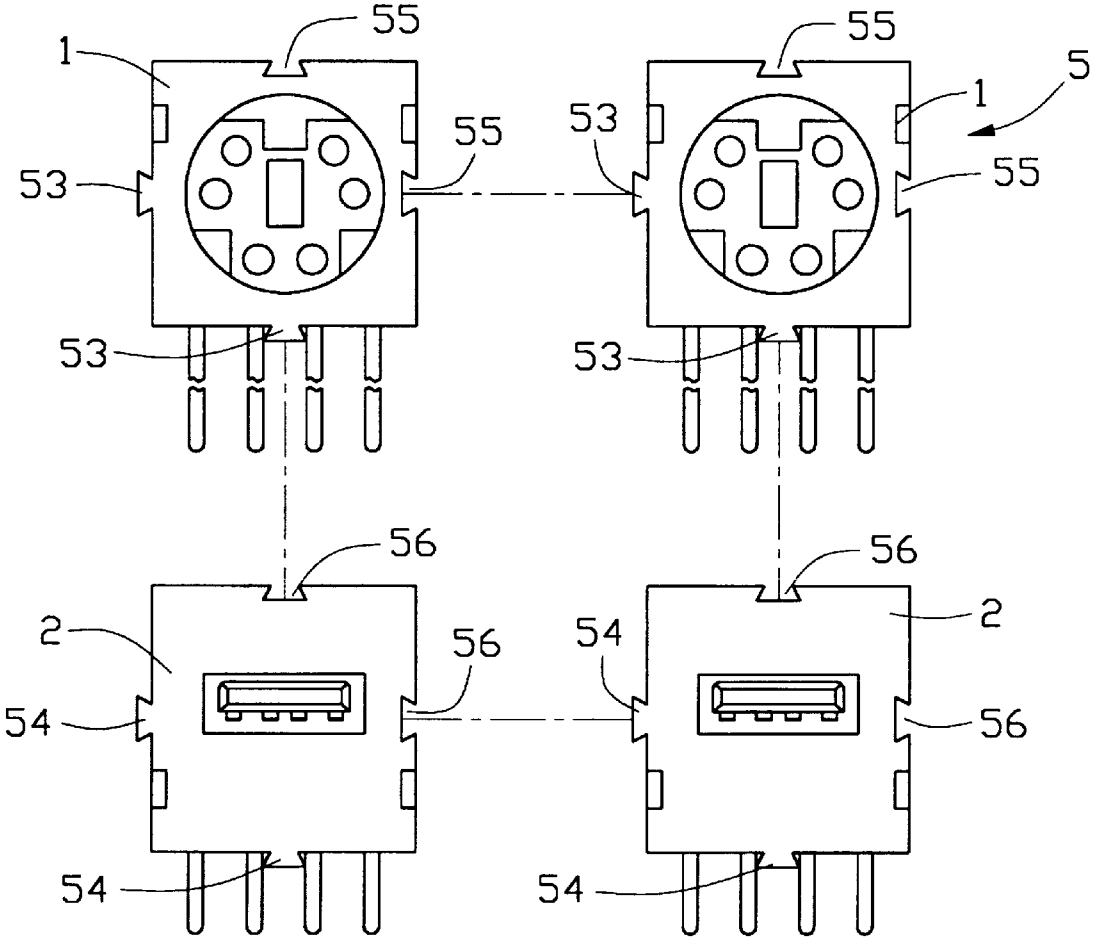
FIG. 4 is the cross section view of another embodiment of the present invention.
Figure 5:
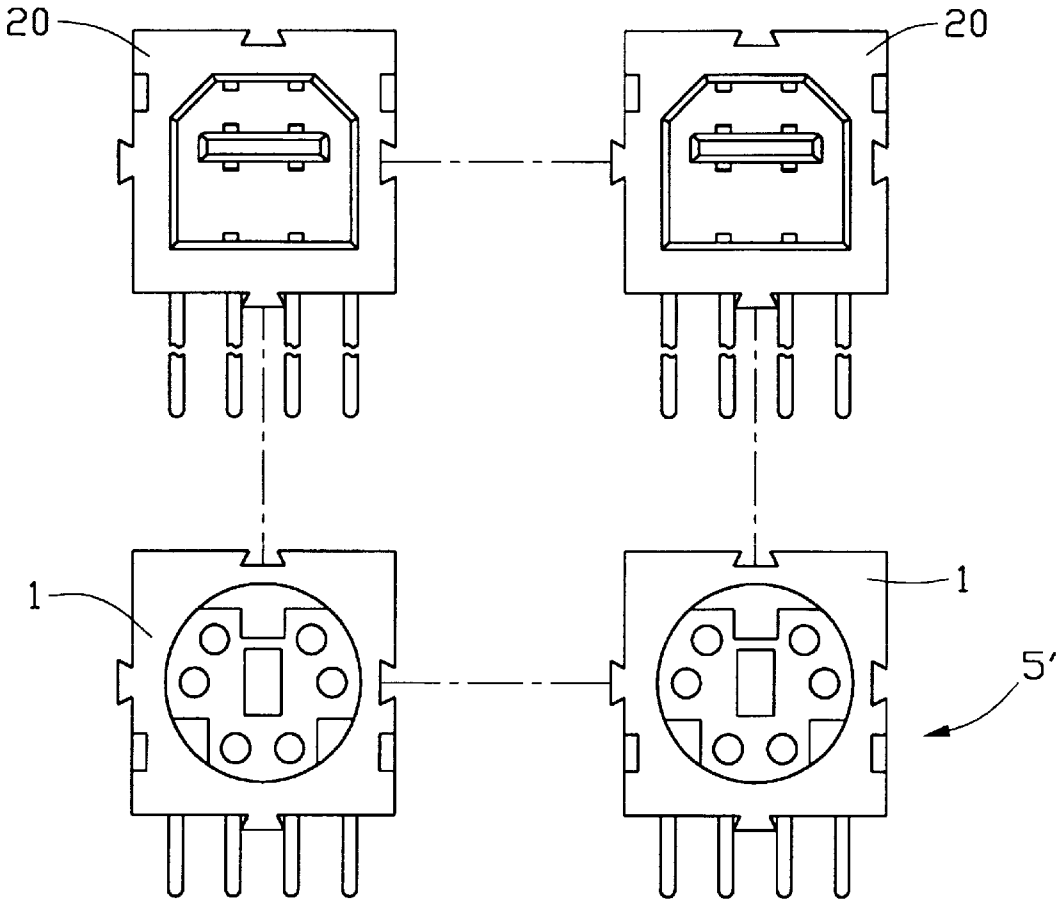
FIG. 5 is the Cross section view of still another embodiment of the present invention.
Figure 6:
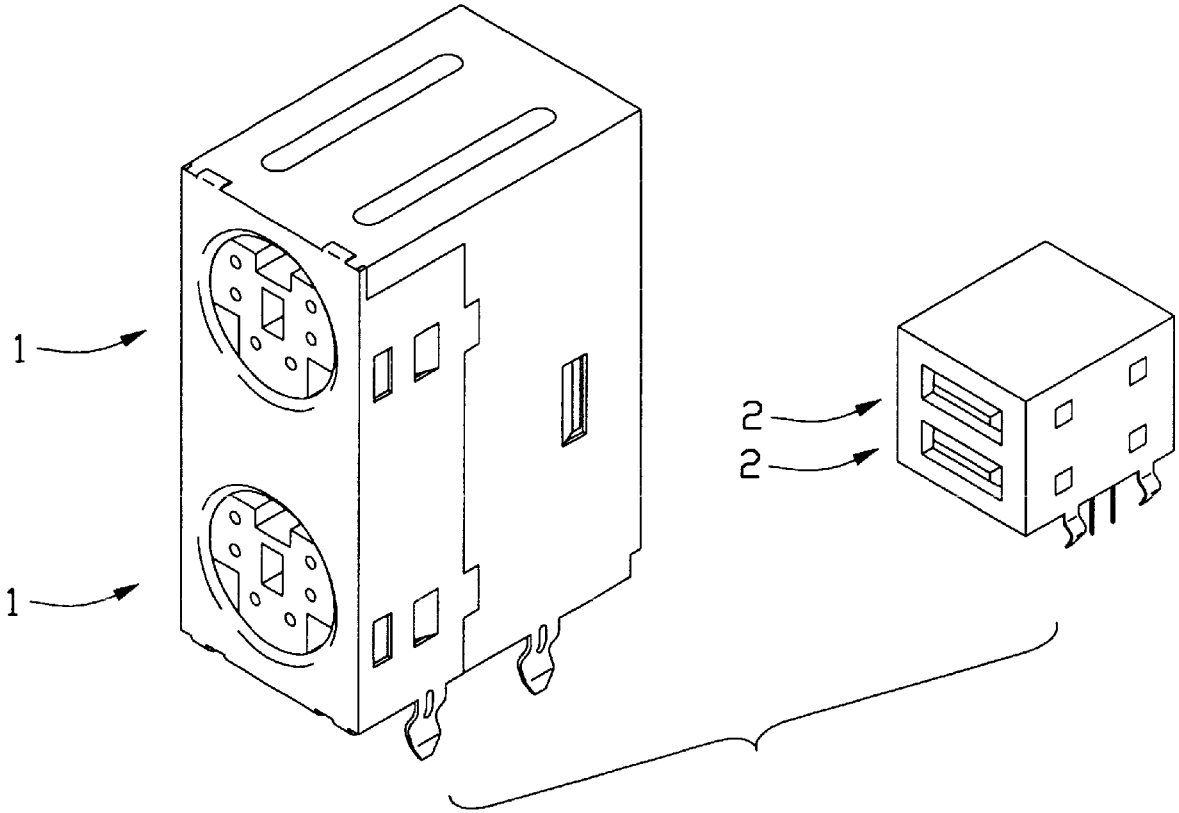
FIG. 6 (PRIOR ART)
FIG. 6 is the perspective view of the conventional connector.
Figure 7:
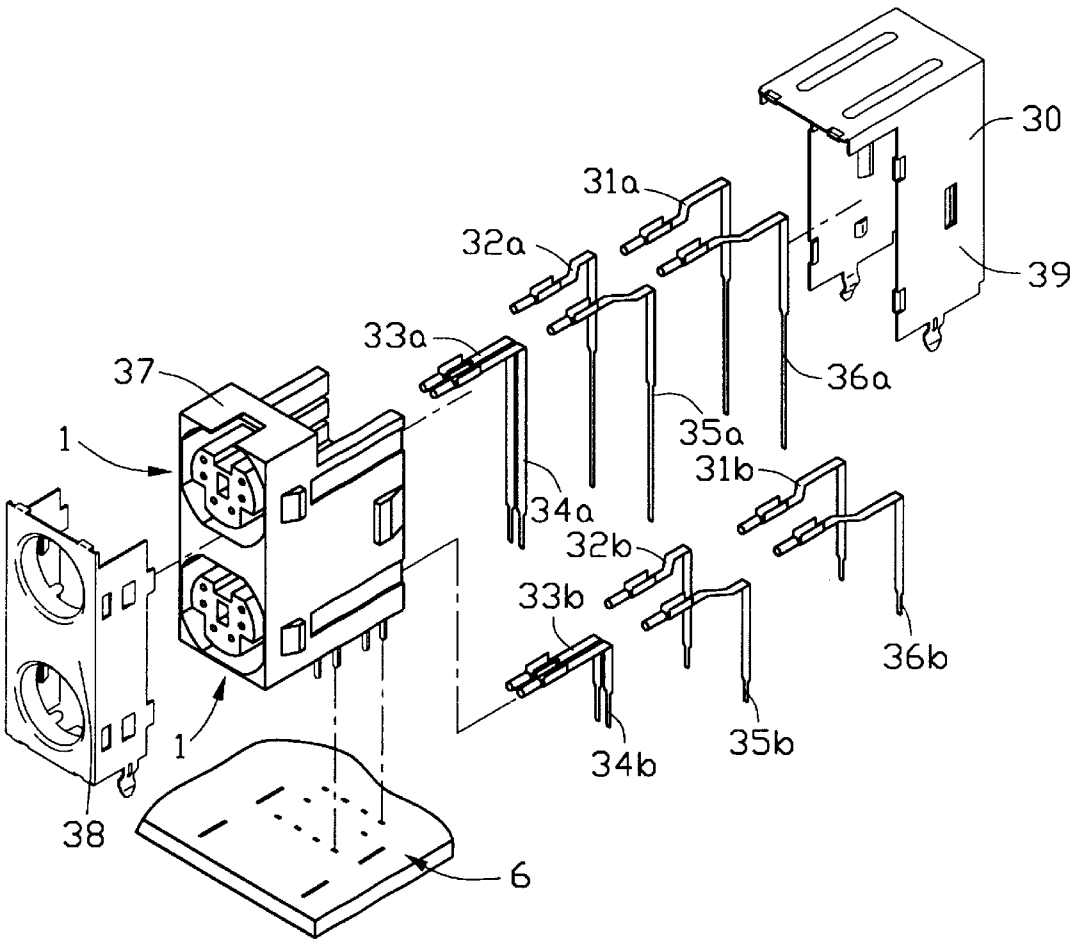
FIG. 7 (PRIOR ART)
FIG. 7 is he cross section view of the conventional connector.

As shown in FIG. 4, the connector assembly comprises two upper PS/2 type connectors 51 and two lower USB type connectors 52. Those connectors use male mating unit such as T-shaped bump or dovetail stage 53, 55, 54, 56 and female mating unit such as T-.shaped groove or dovetail groove 57, 59, 58, 60 for achieving staking arrangement and side-by-side arrangement. Moreover, there are male mating unit and female mating unit arranged between the upper and the lower connectors and between two side-by-side connectors. The PS/2 type connectors 51 and the USB type connectors 52 can be labeled with different color to facilitate the user connect thereto with the plug of the same color, thus preventing careless insertion.. Moreover, the USB type connector 52 can be replaced by high speed USB connector 20.

The present invention is characterized in that two different types of connectors are made of the same height and stacked together. The two different types of connectors generally are of different height, thus being difficult and unaesthetic. Moreover, the inventive connector assembly can be easily modularized to synthesis larger connector.

More important, the two different types of connector in the present invention are manufactured with the same procedure and facility. Therefore, the six molding dies for six terminals of the PS/2 connector, 1 molding die for the 4 terminals of the USB connector. The cost is greatly reduced at the expense that the layout of the main board is slightly modified.

Although the present invention has been described with reference to the preferred embodiment thereof; it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A connector assembly comprising at least two pairs of discrete connectors of different types stacked on an upper level and a lower level, and a shield enclosing said stacked connectors for shielding terminals received in said connectors, said connectors of the same type being arranged on the same level in a side-by-side manner, each said connector having a plurality of male mating units and female mating units on a housing thereof whereby said connectors can be fixedly assembled with each other.

2. The connector assembly as described in claim 1, wherein said connectors on said upper level are PS/2 (Mini-Din) type connectors.

3. The connector assembly as described in claim 1, wherein said connectors on said upper level are USB type connectors.

4. The connector assembly as described in claim 1, wherein one surface of said housing of said connector is provided with one said male mating unit, and a corresponding surface of an adjacent connector or a vertically aligned connector is provided with one said female mating unit such that those said connectors can be arranged in a stacked manner or a side-by-side manner.

5. The connector assembly as described in claim 1, wherein said connectors can be dyed with different colors according to the types thereof.

6. The connector assembly as described in claim 1, wherein said connector housings have the same outer dimensions.

7. The connector assembly as described in claim 1, wherein the male mating units are tenons and the female mating units are mortises.

* * * * *